US011574518B2

(12) United States Patent
Sim et al.

(10) Patent No.: US 11,574,518 B2
(45) Date of Patent: Feb. 7, 2023

(54) JACKPOT MACHINE WITH SURROUND AUDIO

(71) Applicant: Creative Technology Ltd, Singapore (SG)

(72) Inventors: Wong Hoo Sim, Singapore (SG); Teck Chee Lee, Singapore (SG)

(73) Assignee: Creative Technology Ltd, Singapore (SG)

( * ) Notice: Subject to any disclaimer, the term of this patent is extended or adjusted under 35 U.S.C. 154(b) by 113 days.

(21) Appl. No.: 17/349,794

(22) Filed: Jun. 16, 2021

(65) Prior Publication Data

US 2021/0407244 A1 Dec. 30, 2021

Related U.S. Application Data

(60) Provisional application No. 63/046,365, filed on Jun. 30, 2020.

(51) Int. Cl.

| | |
|---|---|
| ***G07F 17/32*** | (2006.01) |
| ***H04R 5/033*** | (2006.01) |
| ***H04S 7/00*** | (2006.01) |

(52) U.S. Cl.

CPC ..... *G07F 17/3204* (2013.01); *G07F 17/3258* (2013.01); *H04R 5/033* (2013.01); *H04S 7/304* (2013.01); *H04S 2400/11* (2013.01)

(58) Field of Classification Search

USPC ..... 463/26, 11, 12, 13

See application file for complete search history.

(56) References Cited

U.S. PATENT DOCUMENTS

| | | | | |
|---|---|---|---|---|
| 10,453,312 | B1 * | 10/2019 | Weaver | G07F 17/3276 |
| 11,238,704 | B1 * | 2/2022 | Weaver | G07F 17/329 |
| 2020/0364987 | A1 * | 11/2020 | Weaver | G07F 17/3225 |
| 2021/0407244 | A1 * | 12/2021 | Sim | H04S 7/30 |
| 2022/0139167 | A1 * | 5/2022 | Weaver | G07F 17/329 463/19 |

* cited by examiner

*Primary Examiner* — Pierre E Elisca

(74) *Attorney, Agent, or Firm* — Russell Swerdon; Desmund Gean

(57) ABSTRACT

A jackpot machine with surround audio is provided. The jackpot machine includes a processor to process at least one audio to generate at least one 3D surround audio, a sending means to send the generated at least one 3D surround audio to a headphone worn by a player, and a display showing at least one graphical representation of a prize. The at least one graphical representation of the prize is associated with the at least one audio, and is perceived by the player to audibly and visually move around the player in accordance with the generated at least one 3D surround audio and the at least one graphical representation of the prize shown on the display respectively.

12 Claims, 3 Drawing Sheets

JACKPOT MACHINE WITH SURROUND AUDIO

CROSS REFERENCES TO RELATED APPLICATIONS

This application claims the benefit of provisional U.S. Patent Application 63/046,365, filed 30 Jun. 2020, and titled, "JACKPOT MACHINE WITH SURROUND AUDIO," the disclosure of which is incorporated herein by reference in its entirety.

TECHNICAL FIELD

The present invention generally relates to a jackpot machine, and more particularly relates to a jackpot machine with surround audio.

BACKGROUND

Jackpot machines are any apparatus (mechanical, electrical, or electromechanical) which, when operated by a player, randomly display images or symbols in a display area. The player wins when symbols that were predetermined to be winners are within the display area. Jackpot machines have progressed from purely mechanical systems where power is provided by the players' arms, to electromechanical systems, to purely electronic systems with games actually played by a local or distal processor and the results displayed on a display such as but not limited to a LCD monitor, computer monitor, a laptop monitor, a tablet device display or a mobile phone display. However, the format of the jackpot game has not changed to take advantage of the progression of the jackpot machines in order to attract more players.

Thus, it can be seen that what is needed is a jackpot machine that is able to enhance the player's experience of playing the game. Furthermore, other desirable features and characteristics will become apparent from the subsequent detailed description and the appended claims, taken in conjunction with the accompanying drawings and this background of the disclosure.

SUMMARY

In one aspect of the invention, a jackpot machine with surround audio is provided. The jackpot machine includes a processor to process at least one audio to generate at least one 3D surround audio, a sending means to send the generated at least one 3D surround audio to a headphone worn by a player, and a display showing at least one graphical representation of a prize. The at least one graphical representation of the prize is associated with the at least one audio, and is perceived by the player to audibly and visually move around the player in accordance with the generated at least one 3D surround audio and the at least one graphical representation of the prize shown on the display respectively.

In another aspect of the invention, a surround audio method for a jackpot machine having a processor and a display is provided. The method includes showing at least one graphical representation of a prize on the display, associating at least one audio to the at least one graphical representation of the prize, processing the at least one audio with the processor to generate at least one 3D surround audio, and sending the generated at least one 3D surround audio to a headphone worn by a player with a sending means. The at least one graphical representation of the prize is perceived by the player to audibly and visually move around the player in accordance with the generated at least one 3D surround audio and the at least one graphical representation of the prize shown on the display respectively.

DETAILED DESCRIPTION OF PREFERRED EMBODIMENTS

The following detailed description is merely exemplary in nature and is not intended to limit the invention or the application and uses of the invention. Furthermore, there is no intention to be bound by any theory presented in the preceding background of the invention or the following detailed description. It is an intent of the various embodiments to present a jackpot machine with surround audio that is able to enhance the player's experience of playing the game.

Figure 1:
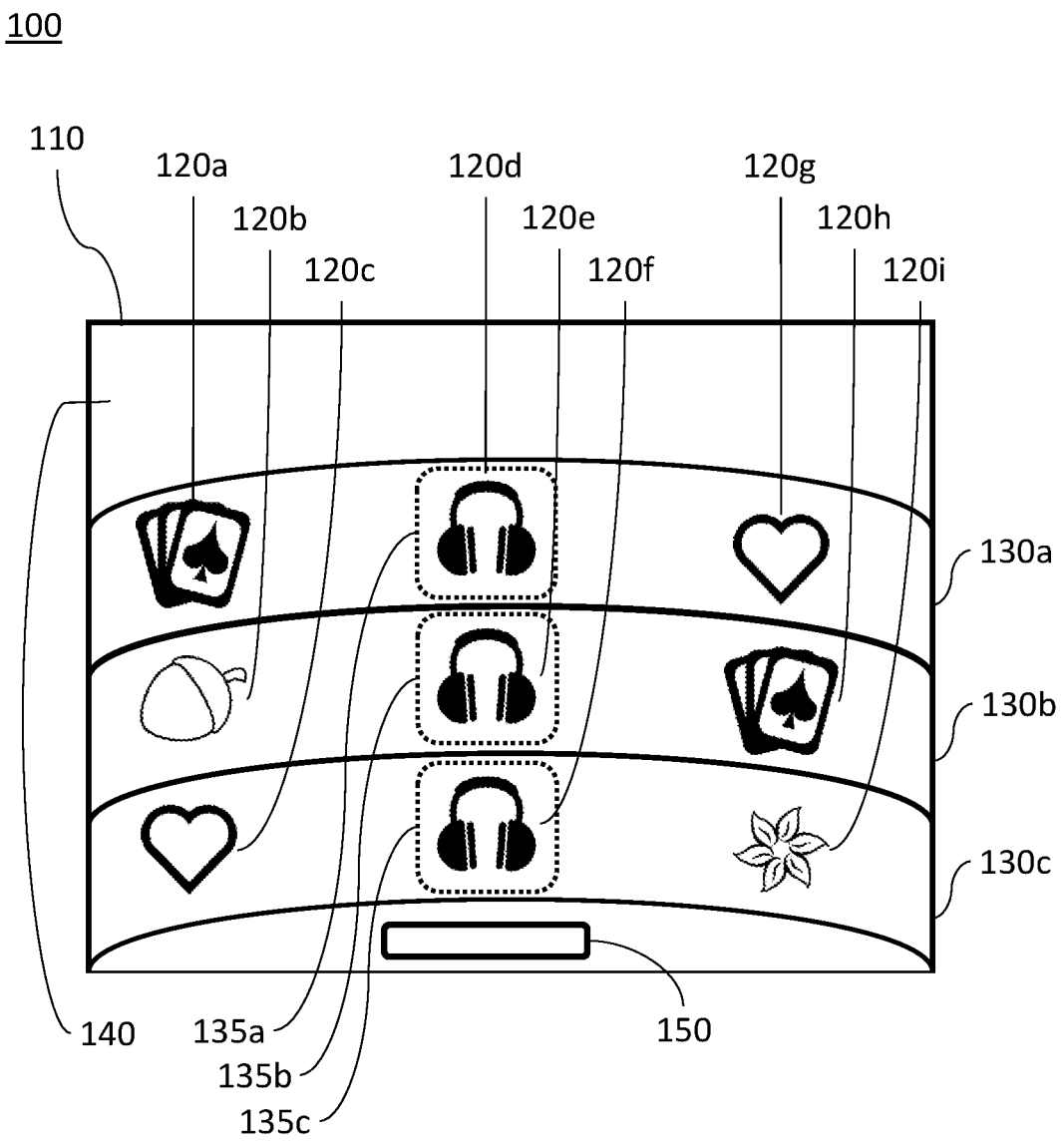
FIG. 1 shows a display of a jackpot machine in accordance with various embodiments.

Referring to FIG. 1, a display 110 of a jackpot machine 100 in accordance with various embodiments is shown. The display 110 of the jackpot machine 100 shows symbols 120*a*-120*i* in a display area 140. A graphical representation of a prize 120*d-f*, such as but not limited to a headphone, a portable speaker, or a consumer product can be shown as one of the symbols 120*a-i*. The graphical representations of the prize 120*d-f* and/or the symbols 120*a-i* are associated with an audio. The symbols 120*a-i* can be positioned along three rows 130*a-c* which may appear to the player to be concave, each row representing a spinning wheel. The symbols 120*a-i* may be positioned on fixed positions in relation to each other on each row. Three winning locations 135*a-c* are predetermined, and these each overlaps a symbol on each of the three rows 130*a-c*. Throughout the description, headphone or headphones may refer to a pair of headphones, or any other audio reproduction devices suitable for hearing sound from.

Although five unique symbols (acorns, flowers, playing cards, hearts and headphone) 120*a-i* are shown, a person skilled in the art will know that there can be fewer or more unique symbols. Similarly, although three rows 130*a-c* and three predetermined winning locations 135*a-c* are shown, a person skilled in the art will know that there can be different numbers of rows and/or winning locations, such as but not limited to one, two, four or five rows and/or winning locations. The number of rows and winning locations do not have to be the same, for example, there can be three rows but only one winning location. The winning location may also be selectable by the player and/or the jackpot machine.

A button 150 may also be shown in the display area, which can be activated by a player to play the game. When activated, the button causes the rows 130*a-c* to spin. Activation can be via touchscreen or by use of a human-machine interface controller such as but not limited to a mouse or a keyboard. When a player activates the button 150, the three rows 130*a-c* on which are positioned the symbols 120*a-i* can be presented on the display such that the player perceives the three rows 130*a-c* on which are the symbols 120*a-i* (including the graphical representation of the prize 120*d-f*) to visually move around the player before coming to a stop. For example, the symbols 120*a-i* and the graphical representations of a prize can repeatably move from a first side of the display area to the opposite side, disappear off the display area and reappearing on the first side before coming to a stop. The three rows 130*a-c* in which are positioned the symbols 120*a-l* (including the graphical representation of the prize 120*d-f*) may spin horizontally, vertically, or about any axis around the player, in a clockwise or anti-clockwise direction. Each row may spin independently from the other rows (For example, symbols 120*b*, 120*e* and 120*h* on row 130*b* may spin horizontally around the player in a clockwise direction, while the other symbols 120*a*, 120*d* and 120*g* on row 130*a* and 120*c*, 120*f* and 120*i* on row 130*c* spin horizontally around the player in an anti-clockwise direction). The symbols that come to a stop may not be the exact same initial symbols as before activation on the display area. Although the total number of symbols are the same, the number of unique symbols and the number of each unique symbols may be different. For example, the three rows as shown has nine symbols, of which there are 5 unique symbols. After activating the button, the three rows will still have nine symbols, but there may be equal, more or less unique symbols, and there may be different numbers of each unique symbols making up the nine symbols (For example, 2 acorns, 2 flowers, 2 playing cards, 2 hearts and 1 headphone after activation instead of the 1 acorn, 1 flower, 2 playing cards, 2 hearts and 3 headphones before activation).

Some of the symbols 120*a-i* may be predetermined to be winners. When these symbols that are predetermined to be winners stop within the predetermined winning locations in the display area, the player wins a predetermined prize. For example, the headphone symbol 120*d-f* may be predetermined to be a winner. When the headphone symbols 120*d-f* stops in each of the predetermined winning locations 135*a-c*, the player wins a predetermined prize. In other words, when each of the predetermined winning locations 135*a-c* are occupied by a similar predetermined winner symbol, the player wins a predetermined prize. In the case of the predetermined winning symbol being a graphical representation of a prize, the predetermined prize may be the prize that is depicted by the graphical representation.

Earlier mentioned, the graphical representations of the prize 120*d-f* and/or the symbols 120*a-i* are associated with an audio, and each of the three rows 130*a-c* has symbols 120*a-i* that are positioned on fixed positions in relation to each other on each row. When the three rows 130*a-c* are spinning, the audio associated with the graphical representations of the prize 120*d-f* and/or the symbols 120*a-i* is processed by a processor in the jackpot machine to generate a 3D surround audio, and sent to the headphones worn by the player through a sending means, such as but not limited to a headphone jack or USB port for connecting to a wired headphone and a wireless audio transmitter or Bluetooth transceiver for transmitting to a wireless headphone. The audio is processed using spatial audio technology such as but not limited to binaural processing using generic head-related transfer functions (HRTFs) and/or binaural room impulse response (BRIR), such that the player audibly perceives the graphical representations of the prize 120*d-f* and/or the symbols 120*a-i* to be moving around the player, with the player in the centre. Additionally, with the use of BRIR (for example), the player can also be virtually audibly transported to his favourite location to play the game. The background of display area 140 can be changed to match the scenery of the favourite location. For example, the player can be virtually transported to a casino or a beach, with corresponding casino or beach scenery shown on the background of the display area 140, and background audio of the casino or the beach sent to the headphones worn by the player. The player can see the casino or beach scenery on the background of the display area 140 on the display 110 and hear the sound of other jackpot machines or waves crashing on the beach through his headphones. The background audio can be positioned anywhere inside the virtual 3D space, preferably in a fixed spatial location in front of the player. Advantageously, the use of such spatial audio technology enhances the player's experience when playing the game by heightening his listening experience through the 3D surround audio and/or replicating an ambience of a location.

Figure 2:
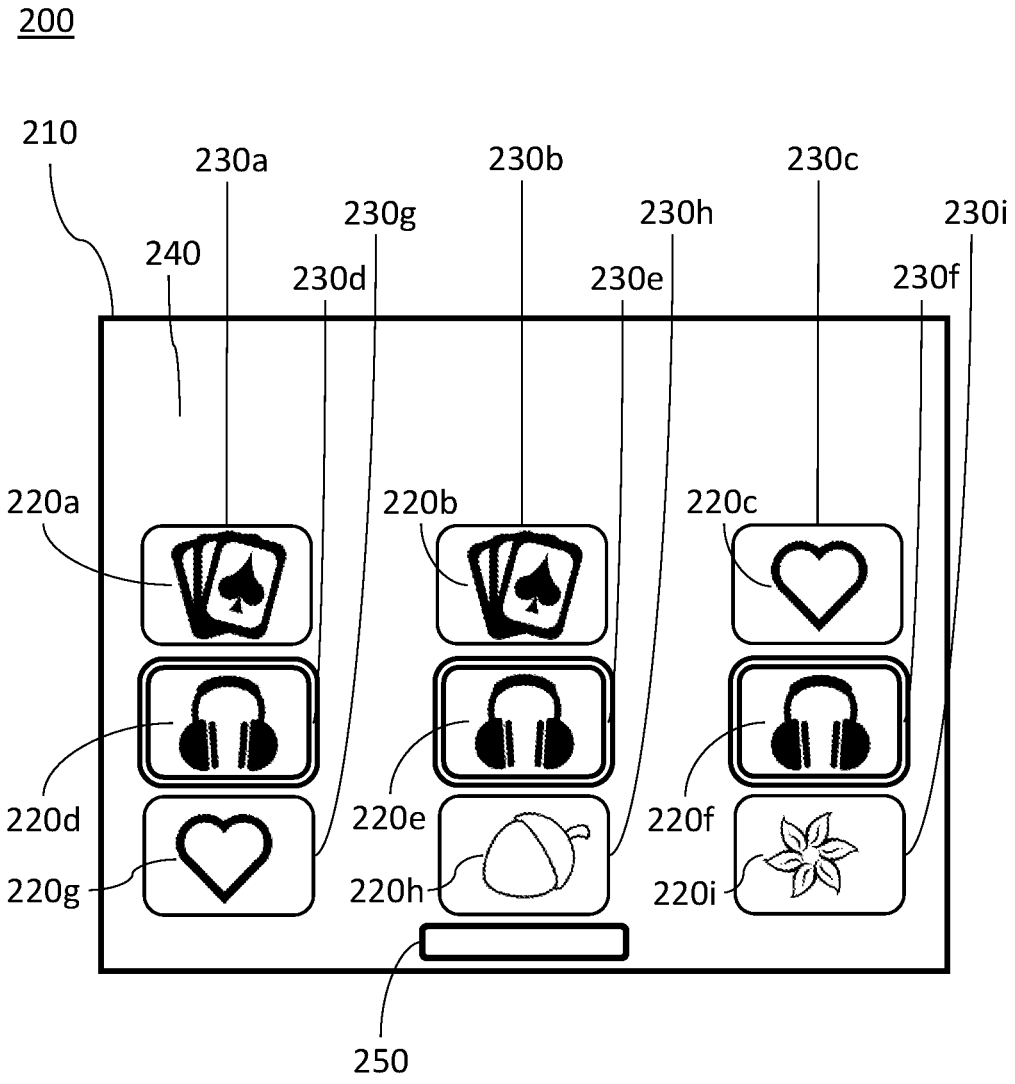
FIG. 2 shows a display of a jackpot machine in accordance with various embodiments.

Referring to FIG. 2, a display 210 of a jackpot machine 200 in accordance with various embodiments is shown. The display 210 of the jackpot machine 200 shows symbols 220*a-i* in a display area 240. A graphical representation of a prize 220*d-f*, such as but not limited to a headphone, a portable speaker, or a consumer product can be shown as one of the symbols 220*a-i*. The graphical representations of the prize 220*d-f* and/or the symbols 220*a-i* are associated with an audio. A number of fixed positions 230*a-i*, each with a symbol 220*a-i* (including the graphical representation of the prize 220*d-f*) located within is shown in the display area 240. Some of the fixed positions are predetermined winning locations, and these are differentiated from the other fixed positions by way of differentiated marking or colouring. For example, fixed positions 230*d-f* are differentiated from the other fixed positions by way of a different border.

Although five unique symbols (acorns, flowers, playing cards, hearts and headphone) 220*a-i* are shown, a person skilled in the art will know that there can be fewer or more unique symbols. Similarly, although nine fixed positions 230*a-i* with three winning positions 230*d-f* are shown, a person skilled in the art will know that there can be different numbers of fixed positions and/or winning positions, from one position up to as many as can reasonably fit in the display area such that the player can still determine the position(s) and symbols visually. The winning location may also be selectable by the player and/or the jackpot machine.

A button 250 may also be shown in the display area, which can be activated by a player to play the game. Activation can be via touchscreen or by use of a human-machine interface controller such as but not limited to a mouse or a keyboard. When a player activates the button 250, the symbols 220*a-i* (including the graphical representation of the prize 220*d-f*) may be shown on screen to traverse around the screen and even go off-screen such that the player perceives the symbols 220*a-i* to be traversing around a virtual 3D space and around him (e.g. on a plane or multiple planes; on parallel or criss-crossing paths) before coming to a stop back within the fixed positions in a random manner from any direction. The symbols viewable on the display area that come to a stop may not be the exact same symbols as before activation, as the number of each unique symbols and the number of unique symbols may be different, although the total number of symbols are the same. For example, the nine positions as shown has nine symbols, of which there are 5 unique symbols. After activating the button, the nine positions will still have nine symbols, but there may be equal, more or less unique symbols, and there may be different numbers of each unique symbols making up the nine symbols (For example, 2 acorns, 2 flowers, 2 playing cards, 2 hearts and 1 headphone after activation instead of the 1 acorn, 1 flower, 2 playing cards, 2 hearts and 3 headphones before activation).

Some of the symbols 220*a-i* may be predetermined to be winners. When these symbols that are predetermined to be winners stop within the predetermined winning locations in the display area, the player wins a predetermined prize. For example, the headphone symbols 220*d-f* may be predetermined to be winners. When the headphone symbols 220*d-f* stop in each of the predetermined winning locations 230*d-f*, the player wins a predetermined prize. In other words, when each of the predetermined winning locations 230*d-f* are occupied by a similar predetermined winning symbol, the player wins a predetermined prize. In the case of the predetermined winning symbol being a graphical representation of a prize, the predetermined prize may be the prize that is depicted by the graphical representation.

Earlier mentioned, the graphical representations of the prize 220*d-f* and/or the symbols 220*a-i* are associated with an audio, and each of the fixed positions 230*a-i* has symbols 220*a-i* that are positioned within. When the symbols 220*a-i* (including the graphical representation of the prize 220*d-f*) are shown visually to be traversing around the screen and going off-screen such that the player perceives the symbols 220*a-i* to be traversing around a virtual 3D space which the player is also virtually within, the audio associated with the graphical representations of the prize 220*d-f* and/or the symbols 220*a-i* is processed by a processor in the jackpot machine to generate a 3D surround audio, and sent to the headphones worn by the player through a sending means, such as but not limited to a headphone jack or USB port for connecting to a wired headphone and a wireless audio transmitter or Bluetooth transceiver for transmitting to a wireless headphone. The audio is processed using spatial audio technology such as but not limited to binaural processing using generic head-related transfer functions (HRTFs) and/or binaural room impulse response (BRIR), such that the player audibly perceives the graphical representations of the prize 220*d-f* and/or the symbols 220*a-i* to be traversing around the player in a virtual 3D space, with the player also virtually positioned in the virtual 3D space. Additionally, with the use of BRIR (for example), the player can also be virtually audibly transported to his favourite location to play the game. The background of the display area 240 can be changed to match the scenery of the favourite location. For example, the player can be virtually transported to a casino or a beach, with corresponding casino or beach scenery shown on the background of the display area 240, and background audio of the casino or the beach sent to the headphone worn by the player. The player can see the casino or beach scenery on the background of the display area 240 on the display 210 and hear the sound of other jackpot machines or waves crashing on the beach through his headphone. The background audio can be positioned anywhere inside the virtual 3D space, preferably in a fixed spatial location in front of the player. Advantageously, the use of such spatial audio technology enhances the player's experience when playing the game by heightening his listening experience through the 3D surround audio and/or replicating an ambience of a location. The synchronization of the audio and visual elements, as well as synchronization between the audio and visual elements may be carried out using variable tempo. Various other synchronization techniques known to the person skilled in the art may also be used.

The jackpot machine (100, 200) may have a receiving means such as but not limited to a card reader, a data entry interface, a transceiver, an Internet connection or USB port for receiving a set of personalization data of the player. The set of personalization data may include the player's HRTF, for example, a personalized HRTF or a generalized representation of the player's HRTF determined through best-match basis to a general grouping of HRTFs, and/or the player's anthropometric measurements or approximation of his ear(s) and upper torso. The audio associated with the graphical representations of the prize 120*d-f*, 220*d-f* and/or the symbols 120*a-l*, 220*a-i* is processed by a processor in the jackpot machine to generate a 3D surround audio based on the personalization data of the player. Advantageously, by processing the audio based on the personalization data of the player, the spatial effect of the 3D surround audio is made even more realistic, further enhancing the player's experience when playing the game. The jackpot machine can process audio and generate personalized HRTF using any suitable technique. For example, the techniques as disclosed in U.S. application Ser. No. 16/853,676, U.S. patent Ser. No. 10/225,682, and U.S. patent Ser. No. 10/390,171, which are hereby incorporated by reference, can be used.

The personalization data may include characteristics of the player's headphones. This may be obtained from the receiving means earlier described. For example, the USB ID may be used to determine the type of headphones plugged into the jackpot machine, the Bluetooth ID may be used to determine the type of headphones wirelessly connected to the jackpot machine, or the player can input the type of headphones he is using through the data entry interface. With the type of headphones, the characteristics of the type of headphones may, for example, be obtained from a look-up table. The audio associated with the graphical representations of the prize 120*d-f*, 220*d-f* and/or the symbols 120*a-i*, 220*a-i* can be processed by a processor in the jackpot machine to generate a 3D surround audio based on the characteristics of the type of headphones. The processing can be based on applying a suitable equalizer setting. Advantageously, by processing the audio based on the characteristics of the headphones, the audio effect of the 3D surround audio is further improved, further enhancing the player's experience when playing the game.

Figure 3:
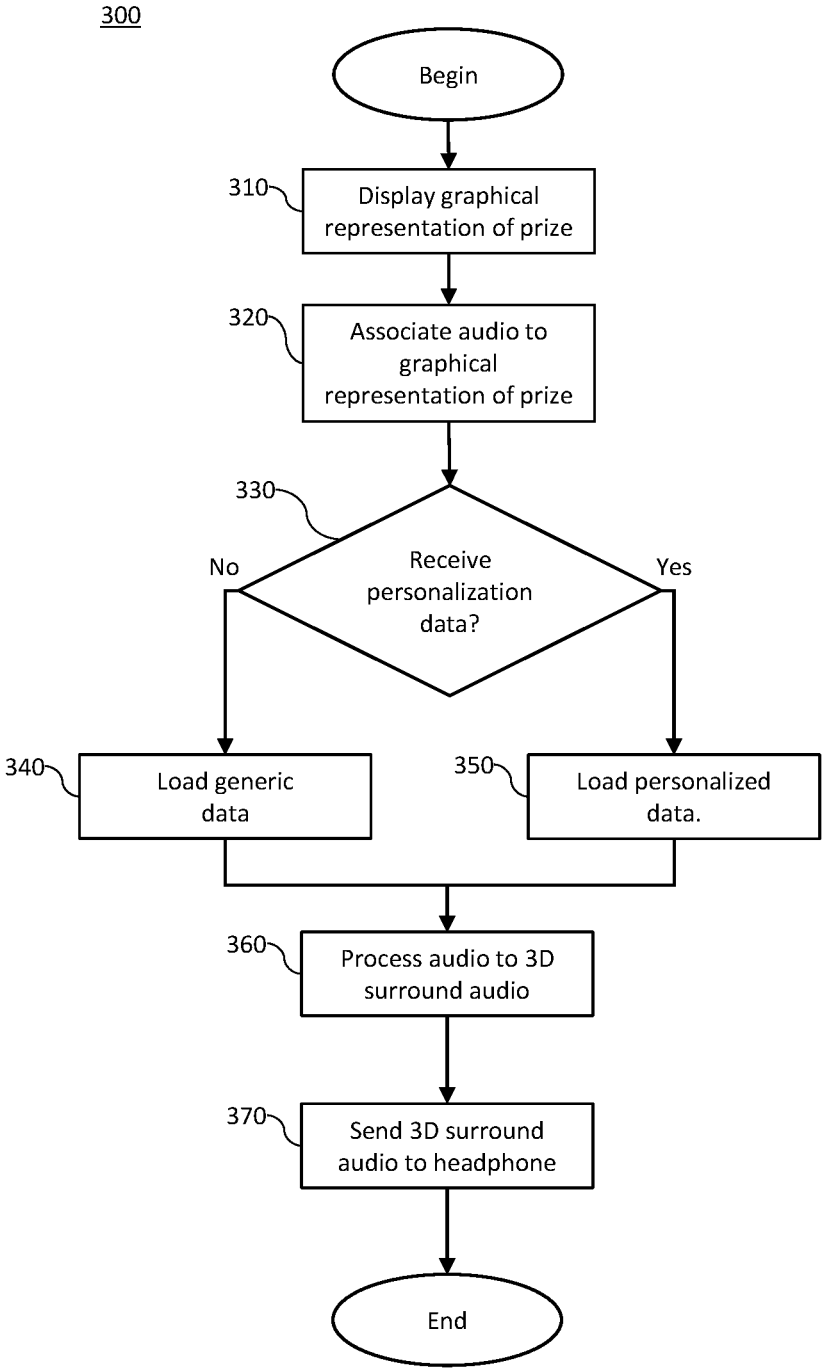
FIG. 3 is a block diagram depicting a method for a jackpot machine with surround audio in accordance with various embodiments.

Referring to FIG. 3, a block diagram depicting a method 300 for a jackpot machine with surround audio in accordance with various embodiments is shown. A jackpot machine is provided with a processor and a display. At least one graphical representation of a prize can be shown on the display of the jackpot machine in step 310, and an audio is associated with the graphical representation of the prize in step 320. In one embodiment, the processor checks if personalization data has been received via a receiving means such as but not limited to a card reader, a data entry interface, a transceiver, an Internet connection or USB port for receiving a set of personalization data of the player in step 330. When the check indicates that no personalization data has been received, the processor will load a set of generic data in step 340. On the other hand, when personalization data has been received, the processor will load the personalized data in step 350. The personalization data may include the player's HRTF, for example, a personalized HRTF or a generalized representation of the player's HRTF determined through best-match basis to a general grouping of HRTFs, and/or the player's anthropometric measurements or approximation of his ear(s) and upper torso. The personalization data may alternatively or in combination also include characteristics of the player's headphones. This may be obtained from the receiving means earlier described. For example, the USB ID may be used to determine the type of headphones plugged into the jackpot machine, the Bluetooth ID may be used to determine the type of headphones wirelessly connected to the jackpot machine, or the player can input the type of headphones he is using through the data entry interface. With the type of headphones, the characteristics of the type of headphones may then, for example, be obtained from a look-up table.

In step 360, the audio associated with the graphical representations of the prize is processed by the processor to generate a 3D surround audio based on either the generic data loaded in step 340 or the personalized data loaded in step 350. Advantageously, by processing the audio using spatial audio technology, the player's experience when playing the game is enhanced by heightening his listening experience through realistic 3D surround audio. More advantageously, by processing the audio based on the personalization data of the player, the spatial effect of the 3D surround audio is made even more realistic, further enhancing the player's experience when playing the game. The jackpot machine can process audio and generate personalized HRTF using any suitable technique. For example, the techniques as disclosed in U.S. application Ser. No. 16/853,676, U.S. patent Ser. No. 10/225,682, and U.S. patent Ser. No. 10/390,171, which are hereby incorporated by reference, can be used.

The audio associated with the graphical representations of the prize may alternatively or in combination also be processed based on the characteristics of the headphones. The processing can be based on applying a suitable equalizer setting. Advantageously, by processing the audio based on the characteristics of the headphones, the audio effect of the 3D surround audio is further improved, further enhancing the player's experience when playing the game.

The audio associated with the graphical representations of the prize is processed using spatial audio technology such as but not limited to binaural processing using head-related transfer functions (HRTFs) and/or binaural room impulse response (BRIR), such that the player audibly perceives the graphical representations of the prize to be traversing around the player in a virtual 3D space, with the player also virtually positioned in the virtual 3D space. Additionally, with the use of BRIR (for example), the player can also be virtually audibly transported to his favourite location to play the game. The background of the display area can be changed to match the scenery of the favourite location. For example, the player can be virtually transported to a casino or a beach, with corresponding casino or beach scenery shown on the background of the display area and background audio of the casino or the beach sent to the headphone worn by the player. The player can see the casino or beach scenery on the background of the display area on the display and hear the sound of other jackpot machines or waves crashing on the beach through his headphone. The background audio can be positioned anywhere inside the virtual 3D space, preferably in a fixed spatial location in front of the player. Advantageously, the use of such spatial audio technology enhances the player's experience when playing the game by heightening his listening experience through the 3D surround audio and/or replicating an ambience of a location. The synchronization of the audio and visual elements, as well as synchronization between the audio and visual elements may be carried out using variable tempo. Various other synchronization techniques known to the person skilled in the art may also be used.

In step 370, the 3D surround audio is sent to the headphones worn by the player through a sending means, such as but not limited to a headphone jack or USB port for connecting to a wired headphone and a wireless audio transmitter or Bluetooth transceiver for transmitting to a wireless headphone.

Although the steps in the block diagram are given sequentially, it should be appreciated that some of the steps can be performed concurrently, or in a different sequence. The steps described may be implemented in hardware, software, firmware, or any combination thereof.

Thus, it can be seen that a device and method for a jackpot machine with surround audio has been provided. An advantage of the present invention is that it provides a way for jackpot machines to have surround audio, and enhances the player's experience when playing the game by heightening his listening experience through the 3D surround audio and/or replicating an ambience of a location.

While exemplary embodiments have been presented in the foregoing detailed description of the present embodiments, it should be appreciated that a vast number of variations exists. It should further be appreciated that the exemplary embodiments are only examples, and are not intended to limit the scope, applicability, operation, or configuration of the invention in any way. Rather, the foregoing detailed description will provide those skilled in the art with a convenient road map for implementing exemplary embodiments of the invention, it being understood that various changes may be made in the function and arrangement of steps and method of operation described in the exemplary embodiments without departing from the scope of the invention as set forth in the appended claims. For example, the headphone can be replaced with speakers or any other sound reproduction devices.

What is claimed is:

1. A jackpot machine comprising:

a processor to process at least one audio to generate at least one 3D surround audio;

a sending means to send the generated at least one 3D surround audio to a headphone worn by a player; and a display showing at least one graphical representation of a prize, wherein the at least one graphical representation of the prize is associated with the at least one audio, and wherein the at least one graphical representation of the prize is perceived by the player to audibly and visually move around the player in accordance with the generated at least one 3D surround audio and the at least one graphical representation of the prize shown on the display respectively.

2. The jackpot machine of claim 1, wherein the at least one graphical representation of the prize spins horizontally around the player.

3. The jackpot machine of claim 1, further comprising:

a receiving means to receive a set of personalization data of the player, wherein the at least one audio is processed according to the set of personalization data.

4. The jackpot machine of claim 3, wherein the set of personalization data includes information about the headphone worn by the player.

5. The jackpot machine of claim 1, wherein the display has a display area with a scenery.

6. The jackpot machine of claim 1, wherein a background audio is integrated with the generated at least one 3D surround audio and positioned in a fixed spatial location in front of the player.

7. A surround audio method for a jackpot machine having a processor and a display, the method comprising:

showing at least one graphical representation of a prize on the display;

associating at least one audio to the at least one graphical representation of the prize;

processing the at least one audio with the processor to generate at least one 3D surround audio; and sending the generated at least one 3D surround audio to a headphone worn by a player with a sending means, wherein the at least one graphical representation of the prize is perceived by the player to audibly and visually move around the player in accordance with the generated at least one 3D surround audio and the at least one graphical representation of the prize shown on the display respectively.

8. The method of claim 7, wherein the at least one graphical representation of the prize spins horizontally around the player.

9. The method of claim 7, further comprising:

receiving a set of personalization data of the player with a receiving means, wherein the at least one audio is processed according to the set of personalization data.

10. The method of claim 9, wherein the set of personalization data includes information about the headphone worn by the player.

11. The method of claim 7, wherein the display has a display area with a scenery.

12. The method of claim 7, wherein a background audio is integrated with the generated at least one 3D surround audio and positioned in a fixed spatial location in front of the player.

* * * * *